US008323133B1

(12) United States Patent
Middendorf

(10) Patent No.: US 8,323,133 B1
(45) Date of Patent: Dec. 4, 2012

(54) FLETCHING FOR ARROWS

(75) Inventor: Marshall G. Middendorf, Coos Bay, OR (US)

(73) Assignee: Norway Industries, Inc., Myrtle Point, OR (US)

( * ) Notice: Subject to any disclaimer, the term of this patent is extended or adjusted under 35 U.S.C. 154(b) by 581 days.

(21) Appl. No.: 12/509,361

(22) Filed: Jul. 24, 2009

Related U.S. Application Data

(60) Provisional application No. 61/219,325, filed on Jun. 22, 2009.

(51) Int. Cl.
*F42B 6/06* (2006.01)

(52) U.S. Cl. ..... 473/586

(58) Field of Classification Search ..... 473/578, 473/585, 586

See application file for complete search history.

(56) References Cited

U.S. PATENT DOCUMENTS 1,648,376 A * 11/1927 Blodgett ..... 269/38
2,628,837 A * 2/1953 Zwickey ..... 473/585
3,527,463 A * 9/1970 Turner ..... 473/585
3,749,403 A * 7/1973 Austin et al. ..... 473/586

OTHER PUBLICATIONS

Martin Archery 2002 Catalogue; cover and pp. 77, 78, 79 and 81.
Norway Industries web page describing and showing prior art Predator™ vanes for arrows.
Norway Industries web page describing and showing prior art Duravanes® vanes for arrows.
Bayer MaterialScience data sheet for prior art Desmopan® 2590A polyurethane product.
Arkema Group data sheet for prior art Pebax® 2533 SN 01 polyether block amide product.
Arkema Group data sheet for prior art Pebax® 3533 SN 01 polyether block amide product.
New England Urethane data sheet for prior art C-4209 H urethane product.

* cited by examiner

*Primary Examiner* — John Ricci
(74) *Attorney, Agent, or Firm* — Klarquist Sparkman, LLP

(57) ABSTRACT

Fletching comprises a first material for a blade portion of the fletching and a second material for a cup portion of the fletching in accordance with one embodiment. These materials can be co-extruded. The vane forming material is desirably stiffer than the cup forming material when cured. In addition, the cup forming material desirably has a greater bondability than the vane forming material. The fletching can also be formed as a shield cut with a relatively high rear edge to facilitate gripping of the fletching as the fletching is mounted to the shaft of an arrow.

23 Claims, 5 Drawing Sheets

FLETCHING FOR ARROWS

CROSS REFERENCE TO RELATED APPLICATION

This application claims the benefit of U.S. Provisional Application 61/219,325, entitled FLETCHING FOR ARROWS, and filed on Jun. 22, 2009.

FIELD

This disclosure relates to fletching for arrows as well as to arrows with such fletching mounted thereon and to methods of manufacturing the fletching.

BACKGROUND

Fletching of an entirely homogeneous blend of polymer materials is known. However, such fletching can be difficult and relatively time consuming to secure to an arrow shaft. In addition, such fletching can have a vane or blade that tends to fold during flight, which can interfere with the true flight of an arrow launched toward a target from a bow.

Therefore, a need exists for improved fletching and to an improved method of manufacturing such fletching.

SUMMARY

In accordance with an embodiment, fletching for an arrow shaft comprises a body comprising a base defining a cup portion for securing to the arrow shaft and a vane portion projecting outwardly from the base and away from the cup portion, the vane portion comprising a first polymer material having a first bondability to an arrow shaft of aluminum or composite carbon material, and the cup portion comprising a second polymer material having a second bondability to an arrow shaft of aluminum or composite carbon material that is greater than the first bondability.

As an aspect of an embodiment, the vane portion can have a stiffness that is greater than the stiffness of the cup portion.

In accordance with an embodiment, the vane portion and the cup portion can be co-extruded.

As an aspect of an embodiment, the vane portion can have a durometer of about 90 or that is 90 on the Shore A scale and the cup portion can have a durometer of about 80 or that is 80 on the Shore A scale. In a desirable alternative, the vane portion can have a durometer of greater than 85 on the Shore A scale and the cup portion can have a durometer of less than 85 on the Shore A scale.

As a further aspect of an embodiment, the cup portion can comprise polyether block amide and less than 10 percent by weight urethane, and the vane portion can consist substantially entirely of urethane and polyether block amide with the urethane being present in an amount that is greater than fifty percent by weight. As an alternative embodiment, the cup portion can consist substantially entirely of polyether block amide, and the vane portion can consist substantially entirely of polyether block amide in combination with urethane, wherein the urethane is present in an amount that is about eighty percent by weight.

In accordance with an embodiment, the cup portion can comprise polyether block amide in an amount that bonds sufficiently to an arrow shaft of aluminum or a composite carbon material within two seconds when pressed against the arrow shaft using a cyanoacrylate adhesive so as to remain bonded to the arrow shaft when pressure is released at the end of said two seconds.

As another aspect of an embodiment, the vane portion can comprise a first forward concave edge portion extending from the front of the body rearwardly to a first transition location intermediate to the front and rear ends, the first transition location being spaced a distance that is at least two thirds of the distance between the front and rear ends from the front end, the vane portion having a height H at the first transition location, the vane portion comprising a second rear convex edge portion extending rearwardly from the first transition location to a second transition location adjacent to the rear of the body, the vane portion having an upright rear edge extending from the rear end to the second transition location.

In accordance with an embodiment, assuming the height of the rear edge is $H_1$, $H_1$ can be about ⅓ H.

In accordance with an embodiment, the vane portion can comprise a first polymer material having a first bondability to an arrow shaft of aluminum or carbon composite material, and the cup portion can comprise a second polymer material having a second bondability to an arrow shaft of aluminum or carbon composite material that is greater than the first bondability.

One or more, and desirably three, of such fletchings are mounted to an arrow shaft with the cup portion being mounted to the arrow shaft to secure the fletching in place.

Fletching comprising combinations and sub-combinations of the above features are within the scope of this disclosure as well as methods disclosed herein for manufacturing fletching comprising combinations and sub-combinations of such features.

DETAILED DESCRIPTION

Figure 1:
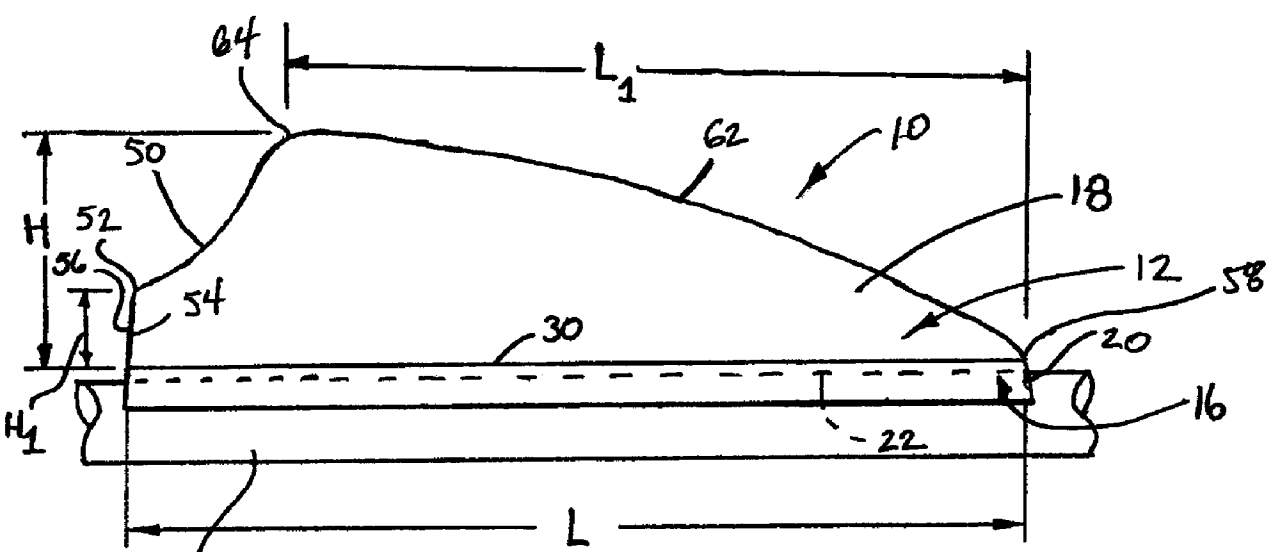
FIG. 1 is a side elevational view of fletching in accordance with an embodiment shown mounted to an arrow.
Figure 2:
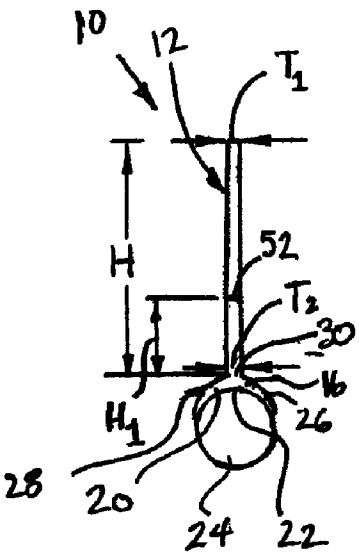
FIG. 2 is an end view of the fletching of FIG. 1, looking toward the left side of the fletching in FIG. 1.
Figure 3A:
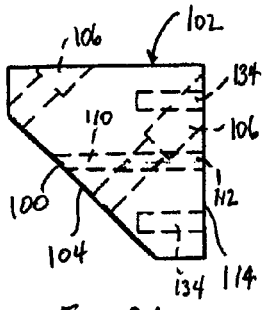
FIG. 3A is an end view of the adapter of FIG. 3, looking toward the left end of the FIG. 3 adapter.
Figure 3:
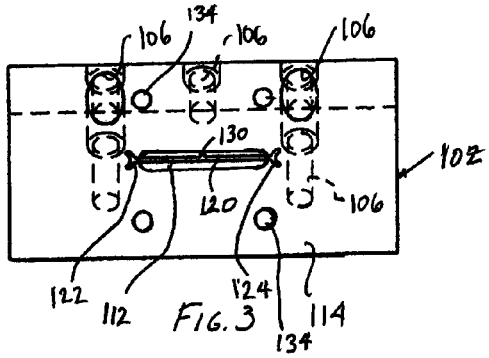
FIG. 3 is a front view of one form of adapter for introducing blade forming material into a co-extruder used for co-extruding blade forming material and cup forming material of the fletching to manufacture, for example, the fletching embodiment of FIG. 1.
Figure 4A:
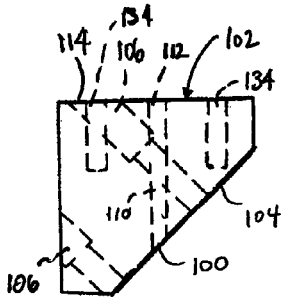
FIG. 4A is an end view of the adapter of FIG. 4, looking toward the left end of FIG. 4.
Figure 4:
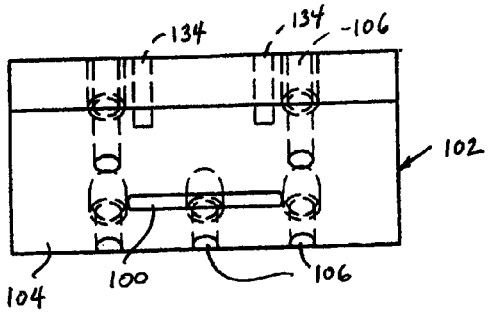
FIG. 4 is a view of the adapter of FIG. 3, rotated counterclockwise 90 degrees from the position shown in FIG. 3.
Figure 5:
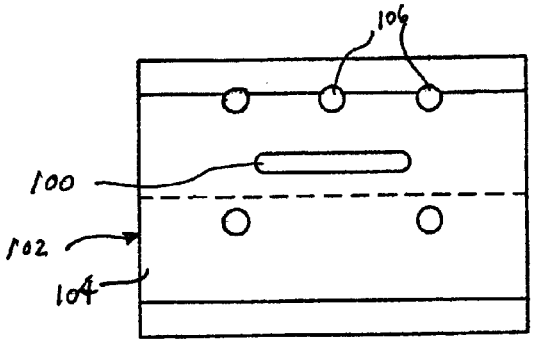
FIG. 5 is a rear view of the adapter of FIG. 3, showing an inlet for blade forming material.
Figure 5A:
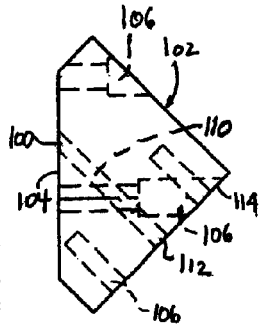
FIG. 5A is an end view of the adapter of FIG. 5, looking toward the right end of FIG. 5.
Figure 6A:
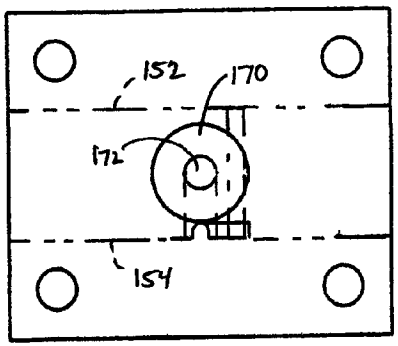
FIG. 6A is an end view of the co-extruder of FIG. 6, looking toward the right end of the co-extruder of FIG. 6.
Figure 7A:
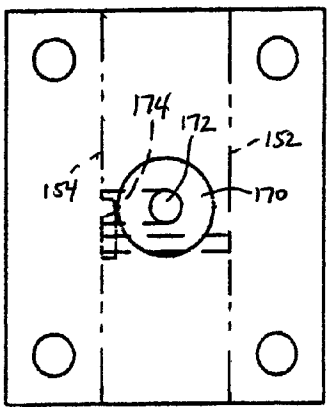
FIG. 7A is an end view of the co-extruder of FIG. 7, looking toward the right end of the FIG. 7 co-extruder.
Figure 6:
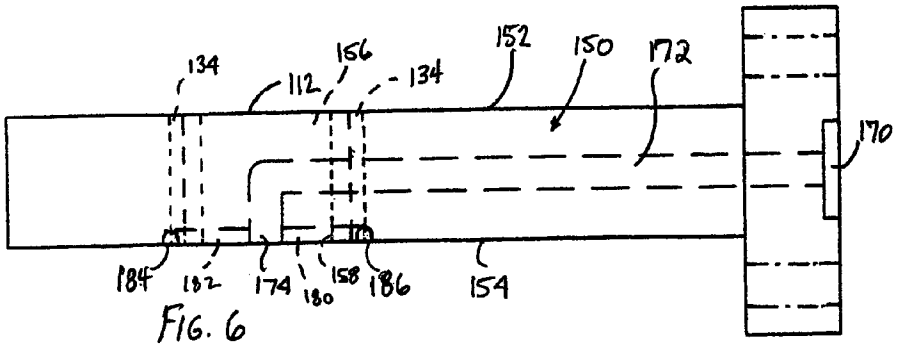
FIG. 6 is a top view of an exemplary co-extruder that can be used to co-extrude blade and cup forming portions of the fletching of FIG. 1.
Figure 7:
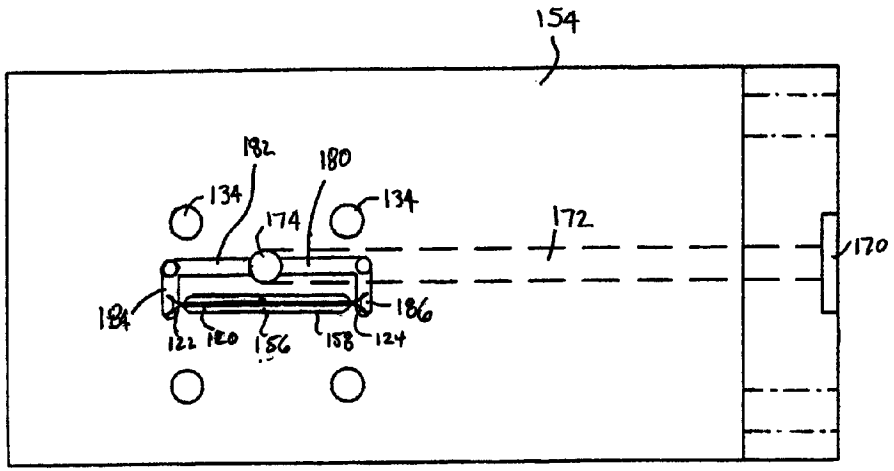
FIG. 7 is a front view of the co-extruder of FIG. 6.

With reference to FIGS. 1 and 2, an exemplary embodiment of fletching for an arrow shaft is indicated at 10. Fletching 10 comprises a body 12 including an elongated base 16 and an elongated blade or vane portion 18. Base 16 defines a cup portion 20 having an arcuate base surface 22 that conforms to a portion of the exterior surface of an arrow 24 when the fletching is secured to the arrow surface. Arcuate portion 22 of the cup 20 typically has a radius of curvature that is less than the radius of the arrow. The fletching in this embodiment desirably is comprised of, and more desirably consists entirely of, a polymer material. Consequently, as the fletching is applied to the arrow, respective elongated leg flange or leg portions 26, 28 of the cup portion 20 spread slightly as the fletching is pressed toward the arrow to achieve a conforming fit. The fletching is secured, such as by adhesive, to the shaft of the arrow.

Desirably, the vane portion 18 and cup portion 20 are of different materials. The phrase different materials include the same constituent or ingredient materials included in different proportions. Thus, the vane portion can be a different blend of the same constituent materials used in the cup portion. Desirably, the vane portion and cup portion comprise extrudable materials. Most desirably, the vane portion and cup portion are co-extruded and joined together during the co-extrusion process, with some intermixing of the vane and cup portion forming materials taking place at the joint between the vane portion and cup portion. It is within the scope of this disclosure for the cup portion to have an outwardly projecting (e.g., an upright portion) with the vane portion then being joined to the cup portion at a location spaced further from the arrow. However, more desirably, the joint between the vane portion and cup portion comprises an elongated joint adjacent to the leg flanges 26, 28 and along the length of the fletching such as indicated by number 30 in FIGS. 1 and 2. An exemplary co-extrusion process for the blade or vane portion and cup portion is explained below.

The vane portion desirably has a stiffness that is greater than the stiffness of the cup portion. In addition, the cup portion is desirably of a material that has a bondability to the arrow shaft that is greater than the bondability of the material forming the vane portion. One method of determining bondability involves applying adhesive (e.g. cyanoacrylate adhesive) to either the arrow shaft or the surface 22 of the base portion and pressing the fletching against the surface of the arrow shaft. One can the measure the amount of time the fletching needs to be pressed against the arrow shaft in order for the fletching to remain bonded to the arrow shaft when pressure is released. By making the cup portion of a material that is less stiff than the material used to form the vane portion, the cup portion more readily conforms to the shape of the arrow shaft and reduces the amount of time the fletching needs to be pressed against the arrow shaft for adhesive to bond sufficiently to prevent the cup portion from popping up or separating from the arrow shaft, due in part to the resiliency of the cup material. Also, a stiffer vane portion assists in directing the arrow in truer flight as a stiffer vane portion resists folding or flexing of the vane that can interfere or alter the flight path of the arrow.

As a more specific description of the relative stiffness of the vane portion and cup portion, in a desirable example, the vane portion is of material having a durometer that is about 90 or that is 90 on the Shore A scale. In addition, the cup portion can be made of material of a durometer that is about 80 or that is 80 on the Shore A scale. As another alternative embodiment, the vane portion can be made of a material having a durometer that is greater than 85 on the Shore A scale, whereas, in contrast, the cup portion can be made of a material having a durometer of less than 85 on the Shore A scale. Again, the material used to form the vane portion and cup portion can be a blend of a plurality of materials or otherwise comprise a plurality of materials. In accordance with one embodiment, the vane portion comprises a first polymer material with a first bondability to an arrow shaft of carbon composite or aluminum material (conventional materials for modern-day arrow shafts). In addition, the cup portion can comprise a second polymer material with a second bondability to an arrow shaft of composite carbon or aluminum with a second bondability that is greater than the first bondability.

In accordance with more specific embodiments of fletching in accordance with this disclosure, the vane portion can be substantially entirely of urethane and polyether block amide with the urethane being present in an amount that is greater than 50% by weight of the material. In addition, the cup portion can comprise or consist entirely of polyether block amide and less than 10% by weight urethane. As another exemplary embodiment, the vane portion can be substantially entirely of polyether block amide and urethane, with the urethane being present in an amount of about 80% by weight of the material. In addition, the cup portion in this embodiment can be substantially of polyether block amide. The durometer of these materials can be changed by altering the blends used to comprise the materials.

It should be noted that the fletching is not limited to these polymer materials. In addition, the blade portion can comprise more than one type of material as can the cup portion. Also, more than two materials or blends of materials can be co-extruded. For example, a third material can be co-extruded as part of the blade portion or cup portion such as where the blade portion joins the cup portion. As a specific example of suitable materials, the blade portion and cup portion can be blends of different polyether block amides with varying quantities of urethane added. As a specific example, the blade portion can be a blend of 40 lbs. urethane (e.g. Desmopan brand 2590A urethane), 5 lbs. Pebax brand 2533 SN 01 polyether block amide, and 5 lbs. Pebax brand 3533 SN 01 polyether block amide. The 2533 SN 01 Pebax brand polyether block amide has a durometer of 75 on the Shore A scale and thus is softer than the 3533 SN 01 Pebax brand polyether block amide, which has a durometer of 83 on the Shore A scale. The 2590A Desmopan brand urethane has a durometer of about 92 on the Shore A scale. In addition, the cup portion can be a blend of 50% 2533 SN 01 Pebax brand polyether block amide and 50% 3533 SN 01 polyether block amide. The durometer of the blade portion and cup portion can be varied by adjusting the quantities of the different materials that are present in the blends. Thus, in this example, the blade portion consists of about 80% urethane and the cup portion has no urethane. Although less desirable, urethane can be added to the cup portion, for example, up to less than 10% by weight urethane. In addition, the blade portion is desirably of polyether block amide with urethane present in an amount that is greater than 50% by weight.

Other polymer materials can be used for the cup and blade portions, with the cup portion materials being selected to bond easily to carbon fiber arrows and aluminum arrows, utilizing a suitable adhesive, such as cyanoacrylate and the blade forming materials desirably being selected to be stiffer than the cup forming materials. In selecting these other materials, the cup forming material is thus desirably less stiff than the material used to form the fletching vane portion. It is also desirable that the materials used in the cup portion can bond to the arrow shaft within a few seconds when an adhesively coated cup surface 22 of the fletching is pressed against the arrow shaft. These exemplary specific blends of Pebax brand materials used for the cup described above have been found to bond to aluminum and carbon composite arrow shafts in less than 2 seconds when cyanoacrylate adhesive is applied to the cup and the fletching is pressed against the arrow shaft. That is, in less than 2 seconds the fletching can be released with the fletching remains bonded to the arrow shaft, even though the cyanoacrylate adhesive is not be entirely cured within that timeframe. This makes fletching in accordance with embodiments of this disclosure easy to apply to arrows utilizing an automated fletching machine, as the fletching can be released sooner to thereby increase the speed of arrow production.

Referring again to FIGS. 1 and 2, although the fletching can have alternative shapes that differ from the shape of the fletching shown in these figures, the shape of the fletching shown in FIGS. 1 and 2 is desirable. Generally, the shape shown in FIG. 1 is termed a shield cut. However, in FIG. 1, a convex cut portion 50 toward the rear of the fletching terminates in a rear edge portion 52 that is spaced a distance $H_1$ from the location 30 where the vane portion joins the cup portion. By having an upright edge 54, which can be inclined from vertical from the rear 56 of the fletching blade toward the front 58 of the fletching vane, or which can be vertical or an another angle, an edge 54 is provided that can more easily be grasped to hold the fletching as it is being secured to the arrow 24. In a desirable embodiment, the height $H_1$ is about one-third of the overall height H of the vane portion of the fletching 10. In addition, the length of the vane portion is indicated as L in FIG. 1. Although variable, in one specific example, L is 2.1 inches, the overall height H of the vane portion is about 0.54 inches, and the thickness of the cup portion (the height of the cup portion or distance between the location 30 where the vane portion joins the cup portion and the surface of the arrow) is 0.018 inch. The vane portion can taper from the location 30 where the vane portion joins the cup portion to the distal edge of the vane portion. For example, there can be a taper from a thickness of about 0.018 inch at $T_2$ to about 0.01 inch at $T_1$ in FIG. 2. The exemplary fletching 10 shown in FIG. 1 has a convex contour along edge 62 from the front 58 of the fletching blade to a transition location 64 where the blade transitions to the concave portion 50. The location of the transition 64 can be varied. In a desirable example, the length or distance between transition portion 64 and the front edge of the fletching blade 58, indicated by $L_1$ in FIG. 1, is a distance that is at least two-thirds of the distance between the front 58 of the fletching blade portion 18 and the rear edge 56 of the fletching blade portion.

One exemplary approach for co-extruding materials forming the blade portion and cup portion of a fletching of FIG. 1 is described below in connection with FIGS. 3-9. In general, the fletching is desirably made by co-extruding resin blends into a profile ribbon. The profile ribbon can then be cooled to a solid form, dried, and partially or entirely cured. Thereafter, individual fletching can be cut from the ribbon, such as using a punch press, to provide the final shape of the fletching. The resulting fletching can then be packaged and allowed to cure fully if desired.

Assuming that the blade portion of the fletching is made of 80% Desmopan 2590A urethane, 10% Pebax brand 2533 SN 01 polyether block amide and 10% Pebax brand 3533 SN 01 polyether block amide, and varying amounts of colorant (which change these percentages insignificantly), and also assuming that the cup portion of the fletching is made of 50% Pebax brand 2533 SN 01 polyether block amide and 50% Pebax brand 3533 SN 01 Polyether Block Amide, an exemplary manufacturing process is as follows. It should be noted that the adapter, co-extruder and profiler components described below can be used for other blends of materials.

The mix forming the blade material can be extruded through an extruder and pushed through, for example, a screen pack of three 20 mesh screens into a nozzle. The direction of flow of material in the nozzle can be altered or changed as desired. As a specific example, the extruder used for introducing the blade material into the adapter can be a 1¾" Davis standard single screw extruder with barrel zone 1 at 305° F., barrel zone 2 at 315° F., barrel zone 3 at 335° F., barrel zone 4 at 360° F., a clamp at 300° F. and a nozzle at 295° F. From the nozzle (not shown), molten blade forming material flows into an inlet 100 of an exemplary adapter block or adapter 102 (see FIG. 5). Inlet 100 for the vane forming material enters through a rear surface 104 of the adapter block 102. Fastener receiving openings (a few of which are numbered as 106 in FIGS. 3, 3A, 4, 4A, 5 and 5A) are provided to receive fasteners, such as bolts, for securing the adapter and extruder components mounted to the adapter in place. Vane forming material entering inlet 100 flows through an internal passageway 110 and through the adapter to a blade forming material adapter outlet 112 exiting through the front surface 114 of the adapter. Superimposed on outlet 112 is the outlet of a profiler, described below, to conveniently illustrate the location of outlet 112 relative to the vane forming portion of the profiler. As can be best seen in FIG. 3, the profiler outlet can comprise a central ribbon forming portion 120 (from which the blade portions of fletching are cut), and respective left and right cup defining portions 122, 124 which are positioned so as not to be filled by the blade forming material introduced into the adapter. The outlet 120 also comprises, in this example, a guide rib forming portion 130 that can be used to index or position the resulting ribbon when the individual fletchings are cut from the ribbon. The adapter 102 also can comprise a plurality of fastener receiving openings, some of which are numbered as 134 in FIGS. 3-5A. These fastener receiving openings 134 can be threaded to receive bolts or other fasteners used to secure the extruder components together.

With reference to FIGS. 6, 6A, 7 and 7A, ay exemplary co-extruder block or co-extruder 150 is shown having a rear surface 152 and a front surface 154. Blade forming material exiting the adapter outlet 112 flows through an internal passageway 156, through the co-extruder block, and exits by way of an exit or co-extruder outlet 158 at the front surface 154 of the co-extruder block. The cup forming portion material is extruded through an extruder, pushed through a nozzle, and also optionally through a screen pack, and into an opening 170 leading to an interior passage 172 of the co-extruder block 150. The extruder used to introduce the cup forming material can be a ¾" Killion single screw extruder with barrel zone 1 at 310° F., barrel zone 2 at 370° F., barrel zone 3 at 410° F., and a nozzle at 350° F. The cup forming material flows through passage 172 to a passage exit 174 from which the material flows into branch passageways 180, 182 to respective cup portion filling exits 184, 186. FIGS. 6, 6A, 7 and 7A illustrate these features in greater detail. The outlet of a fletching profiler is shown superimposed over passageways 184, 186 to illustrate the alignment of the fletching cup forming portions 122, 124 of the fletching profiler with the cup material delivering exits 184, 186 of the co-extruder and the fletching vane forming portion 120 of the profiler with the vane portion material delivery exit 158 of the co-extruder.

Figure 8A:
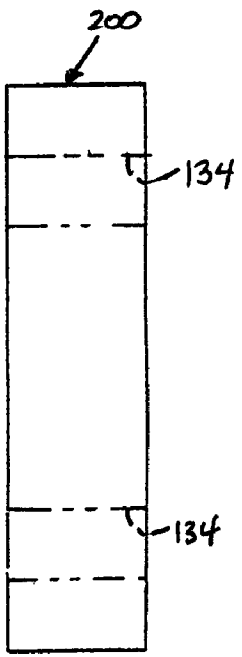
FIG. 8A is an end view of the profiler of FIG. 8, looking toward the right end of the FIG. 8 profiler.
Figure 8:
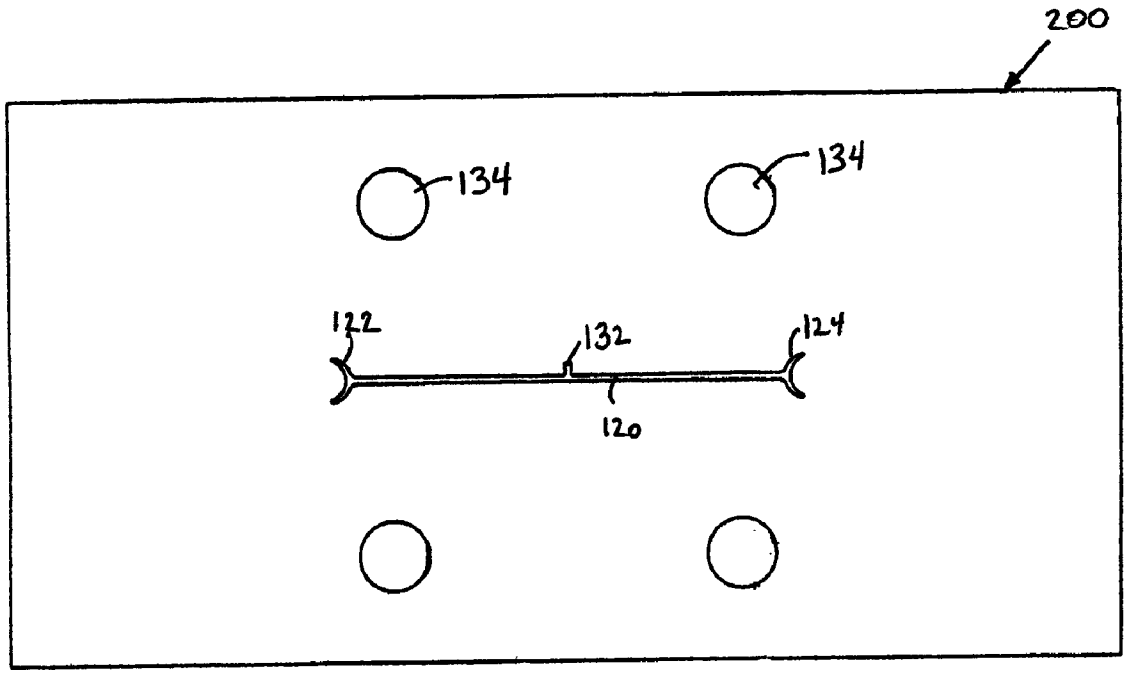
FIG. 8 is a front view of a fletching profiler wherein the co-extruded blade and cup forming material are forced to bond together as extrusion takes place.
Figure 10:
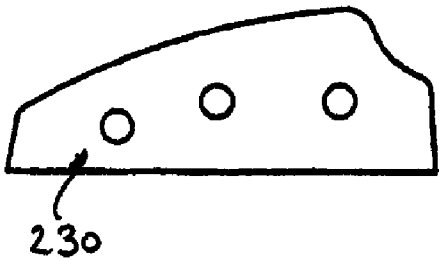
FIGS. 9 and 10 illustrate respective exemplary die (bone) and punch components used to separate finished fletching from a co-extruded ribbon of co-extruded fletching material exiting the profiler.
Figure 9:
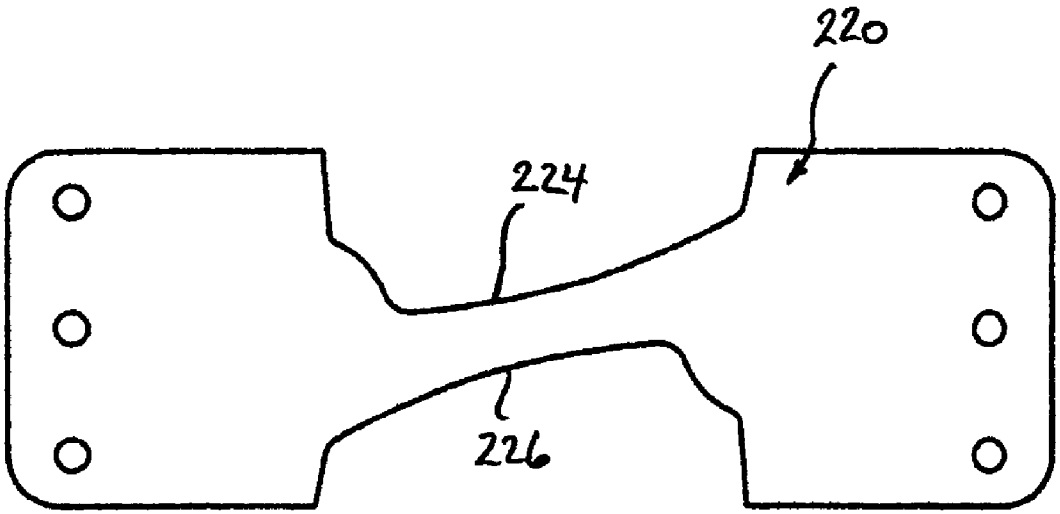

The cup forming material from passageways 184, 186 and blade forming material from passageway 156 in this example flows through a fletching shaped profiler block 200, such as shown in FIGS. 8 and 8A. As cup forming material exits the co-extruder 150, it passes through cup forming portions 122, 124 of the profiler. In addition, the vane forming material passes through the ribbon forming exit passageway 158 of the profiler. The material flows together and is joined at or adjacent to the junction between passageway 120 and the respective passageways 122, 124. The guide rib forming passageway 122 is also shown in FIG. 8. The resulting ribbon that is formed by the profiler 200 is passed through a water quench tank where it solidifies. The ribbon can then be passed by a wheel (e.g. with the ribbon wrapping partially around the wheel) at a lower portion of the quench tank from which the ribbon is pulled through a dryer and measuring device. The ribbon can then enter a curing area wherein it can be passed over rollers and through a sufficient distance and for sufficient time to cure the ribbon sufficiently for further processing. The ribbon can then be passed through a fletching cutout or punching area. The punching area can, for example, comprise a die portion 220 with cutouts, such as at 224 and 226, having the shape of the desired finished fletching. A punch, such as the one shown at 230 in FIG. 10, is provided respectively for each of the die openings 224, 226 for use in punching out and thereby severing the individual fletchings from the ribbon. The guide rib on the ribbon, formed by profiler portion 132, can be used to guide and center the ribbon as it passes through the punch station. A stepper motor can be used to index or pull the ribbon a set distance in successive increments to position successive portions of the ribbon in the punch area for cutting. The resulting fletching can be packaged and allowed to cure further prior to use.

The configuration of the extruder and the temperatures used during extrusion can be varied, for example, to match the materials being used to form the fletching and to produce fletching of different shapes. Also, the exemplary approach results in two cup portions being formed at the respective edges of a center vane forming ribbon. This is efficient, but is not required as, for example, a single cup portion and vane portion could be formed. Other manufacturing approaches can be used, such as injection molding or successively extruding the blade and cup forming portions, but are believed to be less efficient.

It should be noted that the above illustrated embodiments are provided by way of example only and are not to be construed as limiting the breadth of the disclosure. This invention encompasses all novel and non-obvious features and method acts set forth herein both individually and in combinations and sub-combinations with one another. It should be apparent to those of ordinary skill in the art that these embodiments may be modified in arrangement and detail without departing from the inventive concepts disclosed herein. I claim all modifications that fall within the scope of the following claims.

I claim:

1. Fletching for an arrow shaft comprising:

a body comprising a base defining a cup portion for securing to the arrow shaft and a vane portion projecting outwardly from the base and away from the cup portion;

the vane portion comprising a first polymer material having a first bondability to an arrow shaft of aluminum or composite carbon material, the cup portion comprising a second polymer material having a second bondability to an arrow shaft of aluminum or composite carbon material that is greater than the first bondability.

2. Fletching according to claim 1 wherein the vane portion has a stiffness that is greater than the stiffness of the cup portion.

3. Fletching according to claim 1 wherein the vane portion and the cup portion are co-extruded.

4. Fletching according to claim 1 wherein the vane portion has a durometer of about 90 on the Shore A scale and the cup portion has a durometer of about 80 on the Shore A scale.

5. Fletching according to claim 1 wherein the vane portion has a durometer of greater than 85 on the Shore A scale and the cup portion has a durometer of less than 85 on the Shore A scale.

6. Fletching according to claim 1 wherein the cup portion comprises polyether block amide and less than 10 percent by weight urethane, and wherein the vane portion consists substantially entirely of urethane and polyether block amide with the urethane being present in an amount that is greater than fifty percent by weight.

7. Fletching according to claim 1 wherein the cup portion consists substantially entirely of polyether block amide, and wherein the vane portion consists substantially entirely of polyether block amide in combination with urethane, wherein the urethane is present in an amount that is about eighty percent by weight.

8. Fletching according to claim 1 wherein the cup portion comprises polyether block amide in an amount that bonds sufficiently to an arrow shaft of aluminum or a composite carbon material within two seconds when pressed against the arrow shaft using a cyanoacrylate adhesive so as to remain bonded to the arrow shaft when pressure is released at the end of said two seconds.

9. Fletching according to claim 1 wherein the vane portion comprises a first forward convex edge portion extending from the front of the body rearwardly to a first transition location intermediate to the front and rear ends, the first transition location being spaced a distance that is at least two thirds of the distance between the front and rear ends from the front end, the vane portion having a height H at the first transition location, the vane portion comprising a second rear concave edge portion extending rearwardly from the first transition location to a second transition location adjacent to the rear of the body, the vane portion having an upright rear edge extending from the rear end to the second transition location.

10. Fletching according to claim 1 in combination with an arrow shaft wherein the cup portion is mounted to the arrow shaft.

11. Fletching for an arrow shaft comprising:

a body comprising a base defining a cup portion for securing to an arrow shaft and a vane portion projecting outwardly from the base and away from the cup portion;

the body comprising a front end and a rear end;

the vane portion comprising a first forward edge portion extending from the front of the body rearwardly to a first transition location intermediate to the front and rear ends, the first transition location being spaced a distance that is at least two thirds of the distance between the front and rear ends from the front end, the vane portion having a height H at the first transition location, the vane portion comprising a second rear edge portion extending rearwardly from the first transition location to a second transition location adjacent to the rear of the body, the vane portion having an upright rear edge extending from the rear end to the second transition location;

and wherein the vane portion has a stiffness that is stiffer than the stiffness of the cup portion.

12. Fletching according to claim 11 wherein H is greater than one-half inch and the height of the rear edge is $H_1$, wherein $H_1$ is about ⅓ H.

13. Fletching according to claim 11 wherein the vane portion and the cup portion are co-extruded.

14. Fletching according to claim 11 wherein the vane portion comprises a first polymer material having a first bondability to an arrow shaft of aluminum or carbon composite material, and wherein the cup portion comprises a second polymer material having a second bondability to an arrow shaft of aluminum or carbon composite material that is greater than the first bondability.

15. Fletching according to claim 11 wherein the vane portion has a durometer of about 90 on the Shore A scale and the cup portion has a durometer of about 80 on the Shore A scale.

16. Fletching according to claim 11 wherein the cup portion comprises polyether block amide and less than ten percent by weight urethane, and wherein the vane portion comprises urethane and polyether block amide with the urethane being present in an amount that is greater than fifty percent by weight.

17. Fletching according to claim 11 wherein the cup portion consists substantially entirely of polyether block amide and wherein the vane portion consists substantially entirely of polyether block amide in combination with urethane, wherein the urethane is present in an amount that is about eighty percent by weight.

18. Fletching according to claim 11 wherein the cup portion comprises polyether block amide in an amount that bonds sufficiently to an aluminum or a composite carbon arrow shaft within two seconds when pressed against the arrow shaft using a cyanoacrylate adhesive so as to remain bonded to the arrow shaft when pressure is released at the end of said two seconds.

19. Fletching according to claim 11 in combination with an arrow shaft wherein the cup portion is mounted to the arrow shaft.

20. Fletching for an arrow shaft comprising:

a body comprising a base defining a cup portion for securing to an arrow shaft and a vane portion projecting outwardly from the base and away from the cup portion;

the body comprising a front end and a rear end;

the vane portion comprising a first forward convex edge portion extending from the front of the body rearwardly to a first transition location intermediate to the front and rear ends, the first transition location being spaced a distance that is at least two thirds of the distance between the front and rear ends from the front end, the vane portion having a height H at the first transition location, the vane portion comprising a second rear concave edge portion extending rearwardly from the first transition location to a second transition location adjacent to the rear of the body, the vane portion having an upright rear edge extending from the rear end to the second transition location;

the vane portion comprising a first polymer material having a first bondability to an arrow shaft of aluminum or carbon composite material, the cup portion comprising a second polymer material having a second bondability to an arrow shaft of aluminum or carbon composite material that is greater than the first bondability;

wherein the vane portion and the cup portion are co-extruded;

wherein the vane portion has a durometer of about 90 on the Shore A scale and the cup portion has a durometer of about 80 on the Shore A scale; and wherein the cup portion consists substantially entirely of polyether block amide and less than ten percent by weight urethane, and wherein the vane portion consists substantially entirely of urethane and polyether block amide with the urethane being present in an amount that is greater than fifty percent by weight.

21. Fletching according to claim 20 in combination with an arrow shaft wherein the cup portion is mounted to the arrow shaft.

22. Fletching for an arrow shaft comprising:

a body comprising a base defining a cup portion for securing to the arrow shaft and a vane portion projecting outwardly from the base and away from the cup portion;

the vane portion comprising a first polymer material having a first bondability to an arrow shaft of aluminum or carbon composite material, the cup portion comprising a second polymer material having a second bondability to an arrow shaft of aluminum or carbon composite material that is greater than the first bondability;

the vane portion having a stiffness that is greater than the stiffness of the cup portion;

the vane portion and the cup portion are co-extruded;

wherein the cup portion consists substantially entirely of polyether block amide and less than ten percent by weight urethane, and wherein the vane portion consists substantially entirely of urethane and polyether block amide with the urethane being present in an amount that is greater than fifty percent by weight; and wherein the cup portion comprises polyether block amide in an amount that bonds sufficiently to an aluminum or a composite carbon arrow shaft within two seconds when pressed against the arrow shaft using a cyanoacrylate adhesive so as to remain bonded to the arrow shaft if pressure is released at the end of said two seconds.

23. Fletching according to claim 22 in combination with an arrow shaft wherein the cup portion is mounted to the arrow shaft.

* * * * *